US007713072B2

(12) United States Patent
Azzola et al.

(10) Patent No.: US 7,713,072 B2
(45) Date of Patent: May 11, 2010

(54) ADAPTER DEVICE FOR A LOW VOLTAGE SWITCHING DEVICE

(75) Inventors: Lucio Azzola, Bergamo (IT); Stefano Besana, Terno d'Isola (IT)

(73) Assignee: ABB S.p.A., Milan (IT)

( * ) Notice: Subject to any disclaimer, the term of this patent is extended or adjusted under 35 U.S.C. 154(b) by 0 days.

(21) Appl. No.: 12/407,246

(22) Filed: Mar. 19, 2009

(65) Prior Publication Data

US 2009/0239399 A1 Sep. 24, 2009

(30) Foreign Application Priority Data

Mar. 21, 2008 (IT) ..... MI2008A0502

(51) Int. Cl.
*H01R 25/00* (2006.01)

(52) U.S. Cl. ..... 439/119

(58) Field of Classification Search ..... 439/119, 439/267, 637; 361/823, 601, 822, 759, 637–639; 174/70–72 B, 133 B, 140 B
See application file for complete search history.

(56) References Cited

U.S. PATENT DOCUMENTS 5,629,831 A * 5/1997 Eggert et al. ..... 361/624
5,788,517 A * 8/1998 Elmouchi ..... 439/120
6,989,976 B2 * 1/2006 Ashiya ..... 361/27
7,285,724 B2 * 10/2007 Buettner ..... 174/70 B
7,311,543 B2 * 12/2007 Hanning et al. ..... 439/268
7,578,711 B2 * 8/2009 Robinson ..... 439/801
7,600,621 B2 * 10/2009 Lohr et al. ..... 191/23 R

* cited by examiner

*Primary Examiner*—Jean F Duverne
(74) *Attorney, Agent, or Firm*—Connolly Bove Lodge & Hutz LLP

(57) ABSTRACT

The present invention relates to an adapter device for connection of a low voltage switching device to a distribution bus bar system. The adapter device comprises a body provided with a front wall, which can be connected to the switching device, and a back wall, opposite the front wall. The device comprises first electrical terminals susceptible to electrically contact one of the distribution bus bars and second electrical terminals. The device also comprises first electrical connections electrically connected to first electrical terminals and which can be coupled with corresponding third electrical connections of the switching device. The adapter device is also provided with second electrical connection means connected to corresponding second electrical terminals and which can be coupled with corresponding fourth electrical connections of the switching device. The adapter device also comprises a plurality of coupling terminals, at least partly emerging from the back wall of the body, to removably connect the adapter device to the distribution bus bar system. In particular, each of the first electrical terminals electrically contacts one of the distribution bars following the action of one of said coupling terminals.

15 Claims, 9 Drawing Sheets

ADAPTER DEVICE FOR A LOW VOLTAGE SWITCHING DEVICE

The present invention relates to an adapter device for electromechanical connection of a low voltage switching device of the withdrawable or plug-in type to a plurality of conductive bars.

It is known that low voltage switching devices (i.e. for applications with operating voltages up to 1000V AC/1500V DC), such as automatic circuit breakers, disconnectors and contactors, universally called switching devices and subsequently called switches for the sake of brevity, are devices conceived to permit correct operation of specific parts of electrical systems and of the loads installed. For example, automatic circuit breakers ensure that the rated current required can flow towards the various utilities, allowing correct connection and disconnection of the loads from the circuit and automatic sectioning of the circuit protected with respect to the electrical power source. Devices that allow abnormal operating conditions of a specific branch of a system to be recognized and consequent action to be taken with the opening of at least one of the switches present in the circuit are normally known as protective devices. The most widely used protective devices are of the thermal, magnetic, thermal magnetic or electronic type, also in combination with one another.

It is known that switches comprise a case, one or more electric poles, associated with each of which is at least one pair of contacts which can be coupled with and decoupled from each other. Prior art switches also comprise actuating means which cause the relative movement of the pairs of contacts so that they can assume at least a first coupling position (switch closed) and at least a separated position (switch open).

In common use, switches are installed in electrical systems through distribution boards. The use of appropriate distribution boards contributes toward ensuring long term correct functioning, safety conditions, practical and ergonomic use, and if possible also toward enhancing the appearance of the system.

In practical applications distribution boards can have a wide range of configurations, with particular reference to their different constructional and functional nature. For example, dimensions, materials used, fitting of inspection and or protective doors, type of auxiliary equipment and of conductors employed and reciprocal connections can all vary. The conductors present in a board to allow electrical connections can be classified as risers, horizontal bus bars, vertical bus bars, auxiliary power cables, cables for transmitting signals and controls.

Among prior art bus bars, those known as guide bars deserve particular attention; these are structured so as to comprise or integrate adapter devices suitable to allow rapid connection of switches. Said adapter devices conventionally have a dual mechanical and electrical function; in other words, they act as mechanical and electrical interface/connection elements between switch and board.

The choice of the type of switch to use, and in particular of the connection accessories and of the installation methods, must therefore be made taking account of the specific characteristics of the board in which the switch is used. To satisfy the various needs, three distinct modes of installing switches in boards are normally used. In particular, a first installation solution is known as fixed, in which the switch is mechanically constrained directly to support elements of the board, for example a mounting plate, and is directly connected to the conductors of a power supply circuit through its electrical terminals. A second installation solution is known as plug-in, in which a special adapter device is used, which is mechanically constrained to the board and is connected to the conductors of the supply circuit through its own electrical terminals; the switch is then mechanically inserted in this adapter device and is electrically connected thereto through the use of appropriate electrical terminals of the socket/plug type present on the switch and on the base. A third installation solution is known as withdrawable, and is a variant of the previous solution, and differs therefrom substantially only due to the fact that insertion of the switch in the fixed part takes place with the aid of specific guide and/or support means.

Generally, switches and adapter devices (either interface base or adapter) are provided with electrical connection terminals produced according to a basic standard configuration; however, not all installation solutions are suitable to establish electrical connections directly with the standard terminals of the switch or adapter. Therefore, in these cases it is necessary to install adaptation accessories such as additional or replacement electrical terminals which are configured differently according to the application required. These accessories are normally connected to the free ends of the electrodes of the switch. Just as the switches, the support bases must also comprise connection terminals suitable for the electrical system. In other words, when wishing to use plug-in or withdrawable versions of switches, it is necessary to provide adapters and to perform the following operations: mechanically install the adapter on the board; electrically connect it to the bus bar system; fit the switch to the adapter.

Various solutions have been proposed to overcome these prior art drawbacks. For example, the patent application WO 02054432 shows an adapter device comprising a body provided with a surface intended to be coupled with a corresponding coupling surface of a switch. The coupling surface of the adapter device is provided with a first and a second series of electrical connections which are electrically connected to electrical connections provided on the switch. The body of the adapter device comprises a lower surface and a front surface, each provided with electrical contacts. In more detail, the electrical contacts on one of the two surfaces are connected to the first electrical connections, while each contact on the other surface is electrically connected to one of the second electrical connections. The electrical contacts on the surfaces are mechanically and electrically connected to the branch of the distribution network which will be susceptible to be interrupted or not by the action of the switching device that will be connected to the adapter device.

This solution, just like many other similar ones, allows rapid connection of the switch to the adapter device. However, it presents evident limits as it does not allow rapid connection of the adapter device to the distribution network. In fact, this connection is conventionally realized through structural work which in many cases is extremely complex and which requires a considerable amount of resources. The use of prior art adapters also requires a considerable amount of space, above all due to the presence of intermediate copper joining elements (structural work). This drawback results in a substantial waste of useful volume inside the board, leading to a limit in the number of devices that can be installed. Moreover, once implemented, the installation solutions are not easily reversible; in other words, once a solution has been provided, it becomes final or inflexible, and is therefore extremely difficult to convert it into a different solution in the event of need. In this regard, it must also be remarked that subsequent operations to modify and adapt the structural work of a bus bar system inevitably result in deterioration of the conditions of safety and reliability (excessive presence of connecting screws and joining elements, faults in the correct clamping of each screw, modification of the original galvanic separations between phases. Moreover, in almost all cases installation of the adapter device requires prior disconnection of the power supply in the branch of the distribution network involved. In many cases, this condition forms a further limit, above all in certain applications, such as in ships and hospitals.

On the basis of these considerations, the main aim of the present invention is to provide an adapter device for electromechanical installation of a switching device which allows the aforesaid drawbacks of prior art to be overcome.

Within this aim, an object of the present invention is to provide an adapter device that can be installed rapidly in a low voltage system.

Another object of the present invention is to provide an adapter device which can be rapidly and effectively installed in a distribution bus bar system with horizontal or with vertical bus bars.

Another object of the present invention is to provide an adapter device which involves the use of negligible space, so as to be able to provide extremely compact installation solutions, also with adjacent switches placed mutually in contact, with the technical advantage of being able to install a very large number of devices.

Another object of the present invention is to provide an adapter device which is easily reversible, i.e. easy and fast to adapt when required, according to criteria of flexibility, to new installation solutions characterized by the presence of a different number and/or type of installed devices.

Another object of the present invention is to provide an adapter device which is easy to reposition according to countless configurations, without the need to make any modifications or additions to the original bus bar system, i.e. without the bus bar system being exposed to premature deterioration.

Yet another object of the present invention is to provide an adapter device to which a switching device can be operatively connected/disconnected in safe operating safety.

A further object of the present invention is to provide an adapter device which is reliable and relatively easy to produce at competitive costs.

This aim and these objects, as well as others which will be more apparent during the description, are achieved through an adapter device for connection of a low voltage switching device to a distribution bus bar system comprising:

- a substantially prismatic shaped body comprising a front wall, connectable to said switching device, and a back wall opposite said front wall, said body comprising first mutually opposite lateral walls and second mutually opposite lateral walls orthogonal to said first lateral walls;
- first electrical terminals each of which is susceptible to electrically contact a distribution bus bar, said first electrical terminals emerging at least partly from said back wall;
- second electrical terminals emerging from one of said first or of said second lateral walls;
- first electrical connections each of which is electrically connected to one of said first electrical terminals, said first electrical connections which can be coupled with corresponding third electrical connections of said switching device;
- second electrical connections each of which is electrically connected to one of said second electrical terminals, said first electrical connections which can be coupled with corresponding fourth electrical connections of said switching device;
- a plurality of coupling terminals, at least partly emerging from said back wall of said body, to removably connect said adapter device to said distribution bar system, each of said first electrical terminals electrically contacting one of said distribution bus bars following the action of one of said coupling terminals.

The use of the coupling terminals allows rapid installation of the adapter device 1 in a distribution bus bar system regardless of the orientation thereof (vertical or horizontal). Unlike many conventional solutions, installation does not require any prior structural work with evident advantages in terms of labor and relative costs. This distinctive feature is particularly advantageous also in the event of it being necessary to provide new utilities even when it is not possible to disconnect the power supply to the distribution bus bar system. The advantages of the solution described are particularly evident in emergency situations, i.e. where it is necessary to provide a new utility with interruption or a new power source through interruption from or to a distribution bus bar system.

According to another aspect of the present invention, the configuration of the adapter device advantageously allows extremely compact installation solutions to be provided, even with adjacent switches placed mutually in contact, with the technical advantage of being able to install a very large number of devices. The adapter device is easily reversible, i.e. can be easily and rapidly modified if required, according to criteria of flexibility, to new installation solutions distinguished by the presence of a different number and/or type of installed devices. The adapter device can in fact be repositioned according to countless configurations, without the need to make modifications or additions to the original bus bar system, i.e. without the bus bar system being exposed to premature deterioration.

Further characteristics and advantages will be more apparent from the description of preferred but non-exclusive embodiments of the support base according to the invention, illustrated by way of non-limiting example with the aid of the accompanying drawings, wherein.

Figure 1:
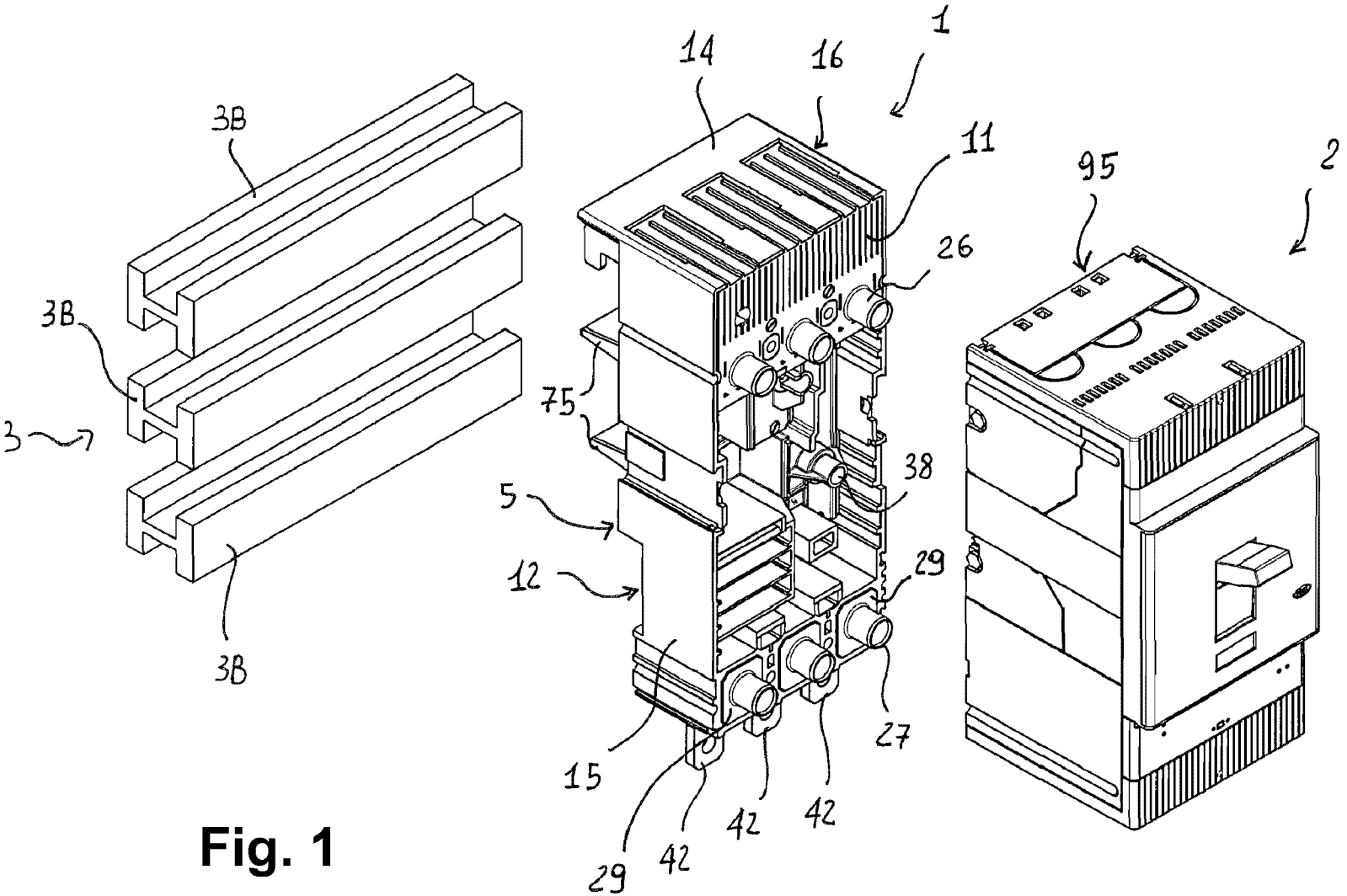
FIG. 1 is an exploded view of a switching unit formed by an adapter device and by a switching device according to the invention installable on a bus bar system.

With reference to the aforesaid figures, the adapter device 1 according to the invention is produced so as to allow electromechanical connection of a switching device 2, such as an automatic circuit breaker, to a distribution bus bar system 3. In this regard, in the following description the switching device 2 will also be indicated with the expression "switch 2" without prejudice to the fact that the technical solutions described below are also valid for other types of switching device of the plug-in or withdrawable type for low voltage systems, such as disconnectors or contactors. Moreover, purely for descriptive purposes, the adapter device 1 will also be indicated with simpler expression "adapter 1".

The adapter device 1 comprises a substantially prismatic shaped body 5 comprising a front wall 11 and a back wall 12 opposite the front wall 11. The front wall 11 can be coupled with a corresponding coupling wall of a switch 2. The body 5 of the adapter 1 comprises a first pair of mutually opposed lateral walls 13, 14 which extend between the front wall 11 and the rear wall 12 in a manner orthogonal thereto. The body 5 also comprises a second pair of mutually opposed lateral walls 15, 16 which extend between the front wall 11 and the back wall 12 also in a manner substantially orthogonal to the first lateral walls 13,14. In a substantially vertical installation mode, the first lateral walls 13, 14 in practice correspond to a lower wall 13 and an upper wall 14 of the body 5, while the second lateral walls 15, 16 form the flanks of the body.

The body 5 comprises first electrical terminals 41 (see FIG. 2) each of which is intended to electrically contact a bus bar 3B of a distribution bus bar system 3 and second electrical terminals 42 each of which connectable to an electrical conductor intended for connection to other parts of the system. With reference to FIG. 3, the body 5 also comprises first electrical connections 21, each of which is electrically connected to one of the first electrical terminals 41, and second electrical connections 22 each of which is electrically connected to one of the second electrical terminals 42. The first 21 and the second electrical connections 22 are electrically connectable to corresponding third 23 and fourth electrical connections 24 of a switch 2. As will be better explained below, the first 21 and the second connections 22 preferably present a "socket" configuration, while the third 23 and the fourth connections 24 of the switch present a "plug" configuration.

The first electrical connections 21 and the second electrical connections 22 are preferably aligned according to mutually parallel directions of alignment 100 (see FIG. 3). These directions of alignment 100 are preferably parallel to the first lateral walls 13, 14 and substantially orthogonal to the second lateral walls 15,16. In other words, the directions of alignment 100 are parallel to the base wall 13 and orthogonal to the flanks of the adapter 1 when this is considered with respect to the vertical installation mode of FIG. 1.

The adapter 1 according to the invention comprises a plurality of coupling terminals 8 which emerge at least partly from the back wall 12 of the body 5 to removably connect the adapter 1 to the distribution bus bar system 3. Following the action of one of the coupling terminals 8 a corresponding first electrical terminal 41 comes into electrical contact with one of the distribution bus bars (3B) (see FIG. 4).

Each terminal 8 comprises a coupling portion 7 disposed in front of the back wall 12 at a distance such as to allow interposing of at least a portion 3C of a distribution bus bar 3B. Each coupling terminal 8 comprises reversible clamping means which drive the coupling portion 7 orthogonally to the back wall 12 to clamp the portion 3C of the bus bar 3 between this coupling portion 7 and the back wall 12. Following the action of said clamping means each of said first electrical contacts 41 electrically contacts one of said distribution bus bars 3.

FIG. 1 shows an adapter device 1 according to the invention and a switch 2 connectable thereto. The front wall 11 of the adapter 1 comprises first hollow cylindrical bodies 26 each of which emerges in a position corresponding to one of the first electrical connections 21 and second hollow cylindrical bodies 27 each of which emerges in a position corresponding to one of the second electrical connections 22. The cylindrical bodies 26, 27 have the purpose of creating a protection for the operators so that the first 21 and the second electrical connections 22 are not immediately accessible, but remain confined and isolated inside the body 5 of adapter device 1. The cylindrical bodies 26, 27 preferably emerge from corresponding inserts 29 applied to the front wall 1 and advantageously act as a guide for insertion of the third 23 and fourth connections 24 of the switch 2 in the corresponding connections 21, 22 of the adapter 1.

Figure 2:
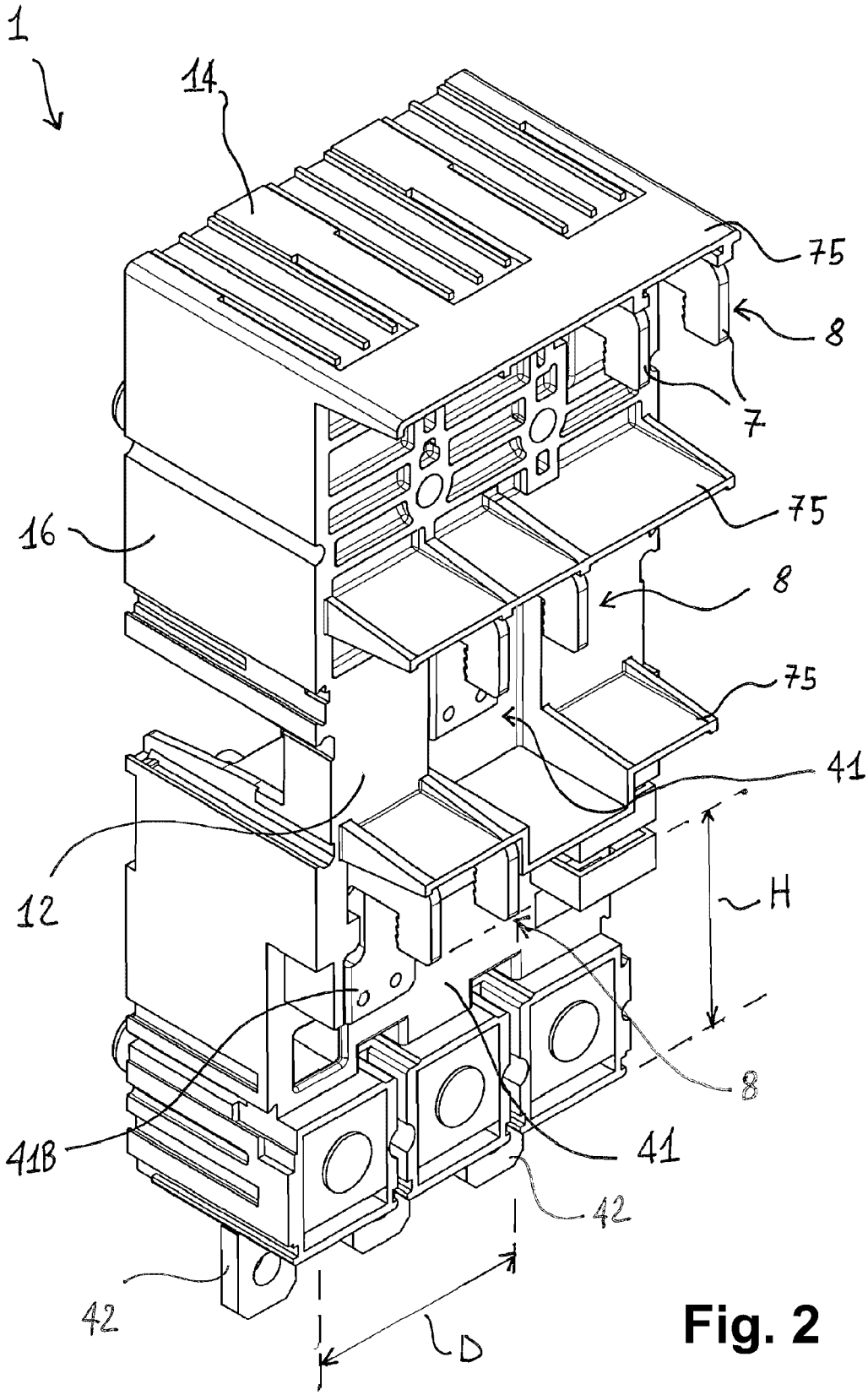
FIG. 2 is a first perspective view of an adapter device according to the invention.
Figure 3:
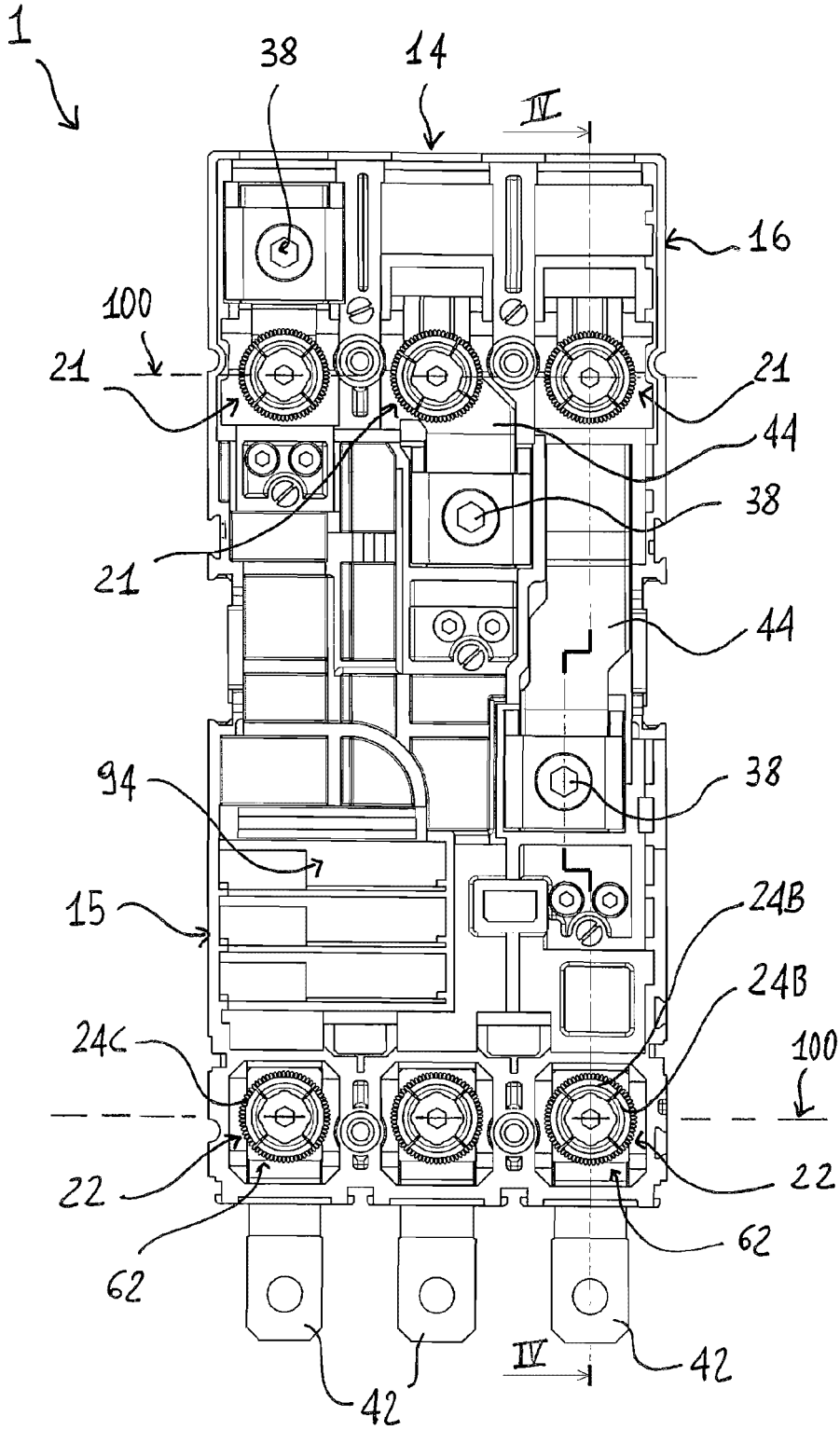
FIG. 3 is a front view of the adapter device of FIG. 2.

FIG. 2 is a first perspective view of an adapter device 1 according to the invention and allows observation in particular of the structure of the back wall 12 of the body 5. According to a preferred embodiment of the invention, each coupling terminal 8 emerges from the back wall 12 with a corresponding coupling portion 7 so that this latter is at a different height H (calculated with respect to one of the first lateral walls 13, 14) and at a different distance D (calculated with respect to one of the second lateral walls 15, 16) with respect to those of coupling portions 7 of other terminals 8. In the particular case shown in FIG. 2, the coupling terminals 8 emerge from the back wall 12 so that the corresponding coupling portions 7 are disposed diagonally with respect to this back wall 12. The difference between the heights of two coupling terminals 8 is chosen as a function of the pitch of the distribution bus bar system 3, or of the distance between the centers of these bus bars.

Again according to a preferred embodiment of the invention, each coupling terminal 8 comprises a pair of coupling portions 7 to advantageously increase the gripping surface and consequently improve the effectiveness of connection thereof. The use of two coupling portions 7 also allows improved distribution of the loads deriving from clamping, benefiting the integrity of the adapter 1. The two coupling portions 7 are preferably operated by the same clamping means, but obviously could also be operated separately.

Figure 4:
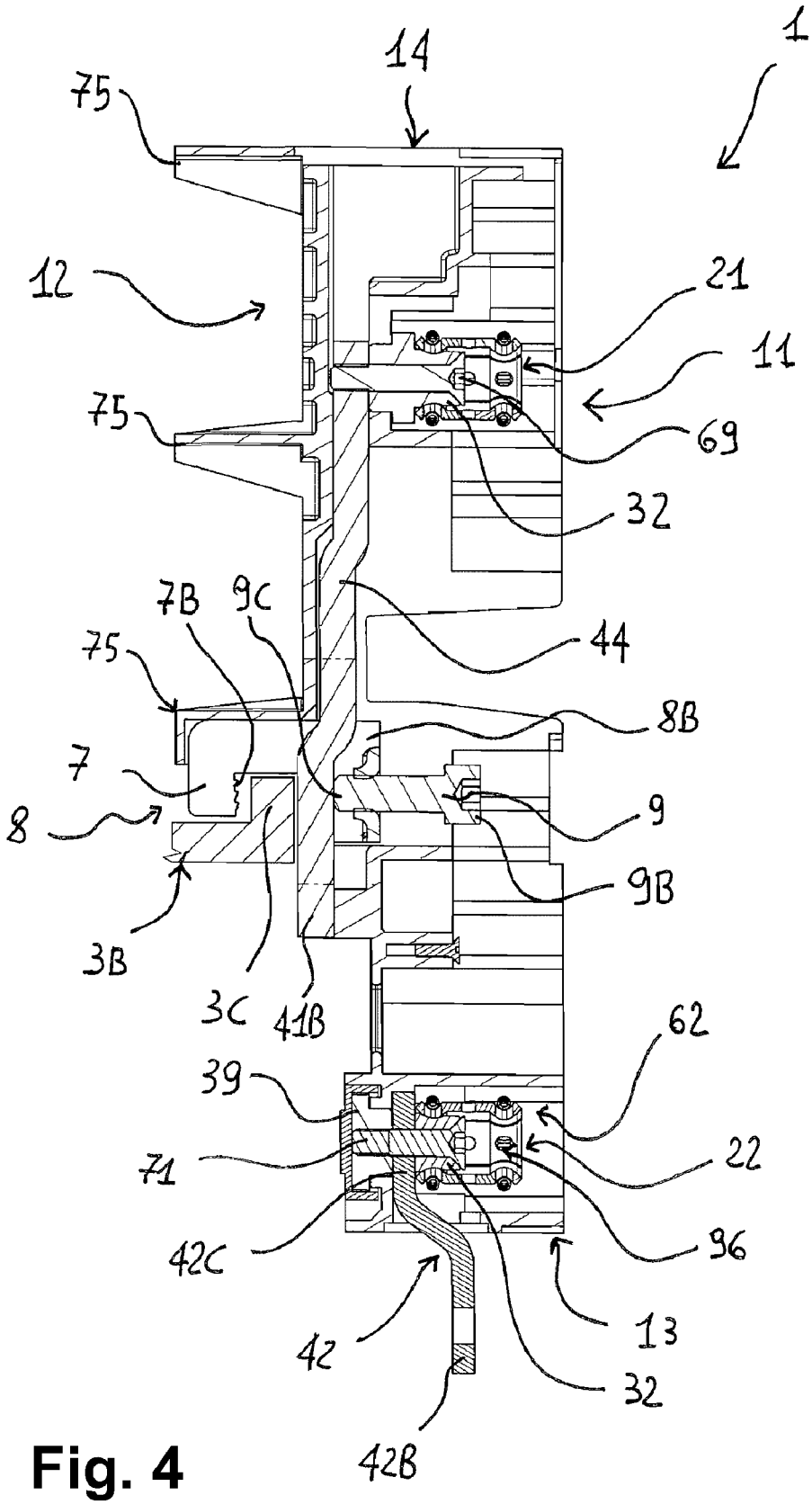
FIG. 4 is a sectional view according to the line IV-IV of FIG. 3.

In the solution shown in FIG. 4, the first electrical terminals 41 are defined at least partly by the coupling portions 7 which are made of metal material. Through this solution, besides producing the mechanical connection, the coupling portion 7 advantageously also produces an electrical connection of the adapter device 1 to the distribution bus bar system 3B.

Again in the solution of FIG. 4, each of the first electrical terminals 41 also comprises a conductive plate 41B which emerges from the back wall 12 so as to occupy, at least partly, a position in front of the coupling portions 7 of one of the terminals 8. Through this solution, once the clamping means are operated, the portion 3C of bus bar 3B advantageously remains between the coupling portion 7 and the conductive plate 41B both made of conductive material.

The coupling portions 7 of the terminal 8 present a contact surface 7B preferably serrated or knurled to increase the gripping effect on the corresponding portion 3C of the distribution bus bar 3B. It has been found that following clamping of the terminals, this technical solution allows a slight surface deformation of the bus bar 3B to be achieved, accompanied by an increase of the conductive effect and of the mechanical seal.

With reference to the view of FIG. 2, the adapter device 1 preferably also comprises one or more insulating elements interposed between the coupling portions 7 of mutually adjacent terminals. In the solution shown, these insulating elements comprise a plurality of separators 75 each of which emerges from the back wall 12 of the adapter 1 in a position immediately adjacent to the coupling portion 7 of a terminal 8 so as to isolate these portions from those relative to the other terminals 8. These separators 75 are preferably produced in one piece with the body 5 of the adapter 1 also made of insulating material.

FIGS. 3 and 4 are respectively a front view and a sectional view of the adapter device of FIG. 2 and allow detailed observation of the internal structure of the body 5 of the adapter 1. In particular, in these figures the inserts 29 and the relative hollow cylindrical bodies 26, 27 have been appropriately removed. With reference to the view of FIG. 3, the first 21 and the second electrical connections 22 are housed in appropriate seats 62 defined inside the body 5 and respectively aligned according to directions of alignment 100 defined above. The first 21 and the second electrical connections 22 preferably present a "socket" configuration so as to couple with respective third 23 and fourth electrical connections 24 of the switch 2 with "plug" configuration. In more in detail, in the solution illustrated, the electrical connections 21, 22 of the adapter 1 comprise a cylindrical body, hollow internally and divided into a plurality of longitudinal sectors 24B mutually connected by elastic elements 24C. These sectors define a cavity 96 (see FIG. 4) inside which a connection with "plug" configuration of the switch 2 is inserted. The presence of elastic elements 24C ensures contact between the surface of the cavity 96 of the "socket" connection and the external surface of the "plug" connection. The cylindrical body of the "socket" connection is in electrical contact with a collector 32 made of conductive material, which is in electrical contact with a corresponding electrical terminal 41 or 42.

The sectional view of FIG. 4 allows detailed observation of the electrical connection between a first electrical terminal 41 and a corresponding first electrical connection 21. As shown, the first electrical terminal 41 comprises a shaped conductive bar 44, a contact portion of which emerges from the back wall 12. In particular, this contact portion preferably coincides with the aforesaid conductive plate 41B of the first electrical terminal 41.

The shaped conductive bar 44 extends inside the body 5 of the adapter device 1 and is mechanically and electrically connected to the collector 32 of a first electrical connection 21 through a fixing screw 69 which is coaxial with this connection or with the collector 32.

In the solution shown in FIG. 4 the part of the coupling terminal 8 emerging from the back surface 12 is substantially L-shaped with one side configuring the coupling portion 7. The clamping means comprise at least one fixing screw 9 whose axis is substantially orthogonal to the back wall 12. The fixing screw 9 engages with a threaded portion 8B of the coupling terminal 8 substantially opposite the coupling portion 7 and so as to be inside the body 5 of the adapter 1. The head 9B of the fixing screw 9 is accessible to an operator by virtue of at least one appropriate cavity 38 (see FIG. 3) defined in the internal structure of the body 5 of the adapter 1. These cavities 38, preferably cylindrical in shape, are advantageously produced in one piece with the body 5 of the adapter 1 and extend so as to define an obligatory path for the tool (such as a key or a screwdriver) which can be used to clamp the screw.

The end of the screw 9C opposite the head 9B contacts the internal surface of the conductive bar 44 which offers a stop surface during clamping of this screw. In particular, as a result of this stop surface the screw 9 remains axially locked and this determines relative movement of the threaded part 8B of the terminal 8 or of the relative coupling portion 7 integral therewith. Consequently, the coupling portion 7 moves towards or away from (depending on the direction of rotation of the screw 9) the back wall 12, producing or eliminating the clamping action on the corresponding distribution bus bar 3B.

Again with reference to the sectional view of FIG. 4, the second electrical terminals 42 emerge from one of the first lateral walls 14, 15, for example from the lower wall considered with respect to vertical installation of the adapter device 1. Each of these second terminals 42 comprises a shaped element made of conductive material connected, preferably directly, to one of the second electrical connections 22 through screw fixing elements. In particular, this shaped element comprises a first external 42B connectable to an electrical conductor (not shown) outside the adapter 1 and an internal portion 42C connected to the collector 32 of a corresponding second electrical connection 22. This latter connection is realized by second screw fixing means 71. These means act so that the internal portion 42C of the second terminal 42 remains clamped between the collector 32 and a mating element 39.

Figure 5:
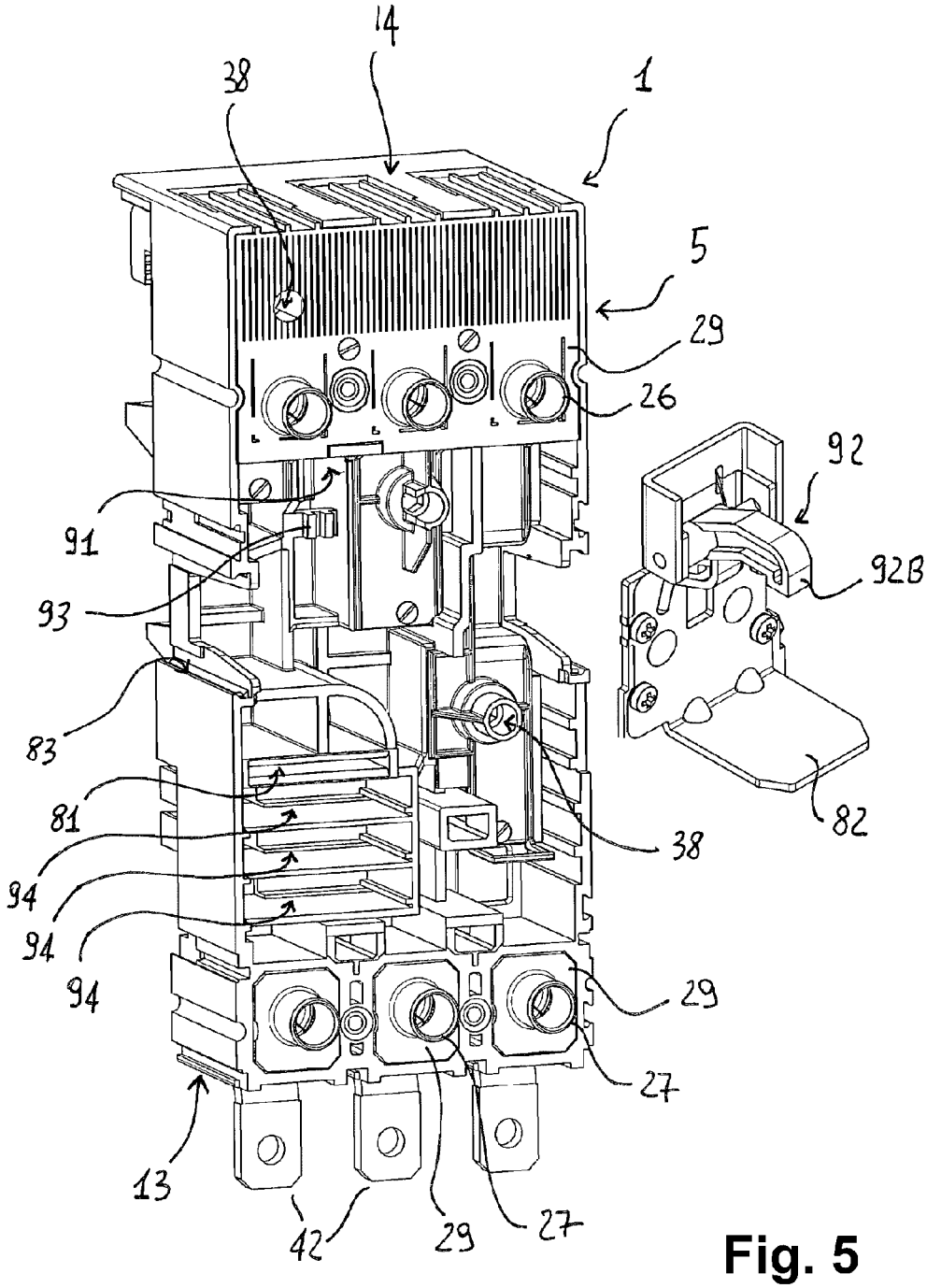
FIG. 5 is a second perspective view of the adapter device of FIG. 2.

FIG. 5 is a perspective view of the adapter 1 and allows observation of another distinctive feature thereof. In particular, the body 5 comprises first mating means which cooperate with second mating means of the switch 2. In practice, these means have the function of guiding correct coupling between the switch 2 and the adapter 1.

In the solution shown in FIG. 5, the first mating means comprise a drawer cavity 81 in which a guide plate 82 (shown at the side of the adapter 1), applied to the coupling wall 95 of the switch 2, can be inserted. The drawer cavity 81 is dimensioned so that its internal walls contact the corresponding edges of the guide plate 82 so as to guide coupling according to a direction substantially orthogonal to the front wall 11 of the adapter 1.

Again with reference to FIGS. 3 and 5, the adapter 1 advantageously also comprises first interlock means which cooperate with second interlock means of the switch 2 once this is coupled with the adapter 1. In particular, these interlock means have the function of preventing removal of the connection between the two devices (switch 2 and adapter 1) when the switch 2 assumes a "closed" (ON) configuration. In other words, the switch can only be unplugged or withdrawn when it is in the "open" (OFF) or tripped positions.

In the solution shown, the first interlock means comprise a housing cavity 91, in which a hook-shaped operating end 92B of an interlock lever 92 (shown and indicated at the side of the adapter 1 in FIG. 5) emerging from the back coupling surface 5 of the switch 2, can be inserted. The cavity 91 is provided with a locking end 93 which couples the hook end 92B of the interlock lever 92 when this is in a locked operating position. In this coupling condition, the switch 2 cannot be removed from the adapter 1. Conversely, when the interlock lever 92 assumes a released operating position, corresponding to the open or tripped positions of the switch 2, removal is possible as the operating end 92B is released from the locking end 93.

Again with reference to FIG. 5, the body 5 of the adapter device 1 advantageously also comprises one or more auxiliary cavities 94 in each of which it is possible to place accessory devices, such as position contacts, or accessories similar to those that can normally be placed inside the switch. In the solution shown the body 5 comprises, for example, a plurality of auxiliary cavities 94, drawer-shaped and defined in one piece with this body.

According to a possible embodiment of the adapter 1, at least one of the aforesaid second lateral walls 15, 16 is configured so as to allow positioning of first connector means (visible in FIG. 8) suitable to couple with corresponding second connector means of the switch 2. These connector means perform a supply and/or control function of accessory devices of the switch.

In the embodiment of FIG. 5, at least one of the lateral walls comprises guide and support grooves 83 which allow the first connector means 97 to be integrated in the structure of the body 5. These support grooves extend according to the direction of coupling of the switch 2 to the adapter 1 to allow simultaneous coupling of the first connector means 97 to the corresponding second connector means 92 associated with a flank of the switch 2.

Figure 6:
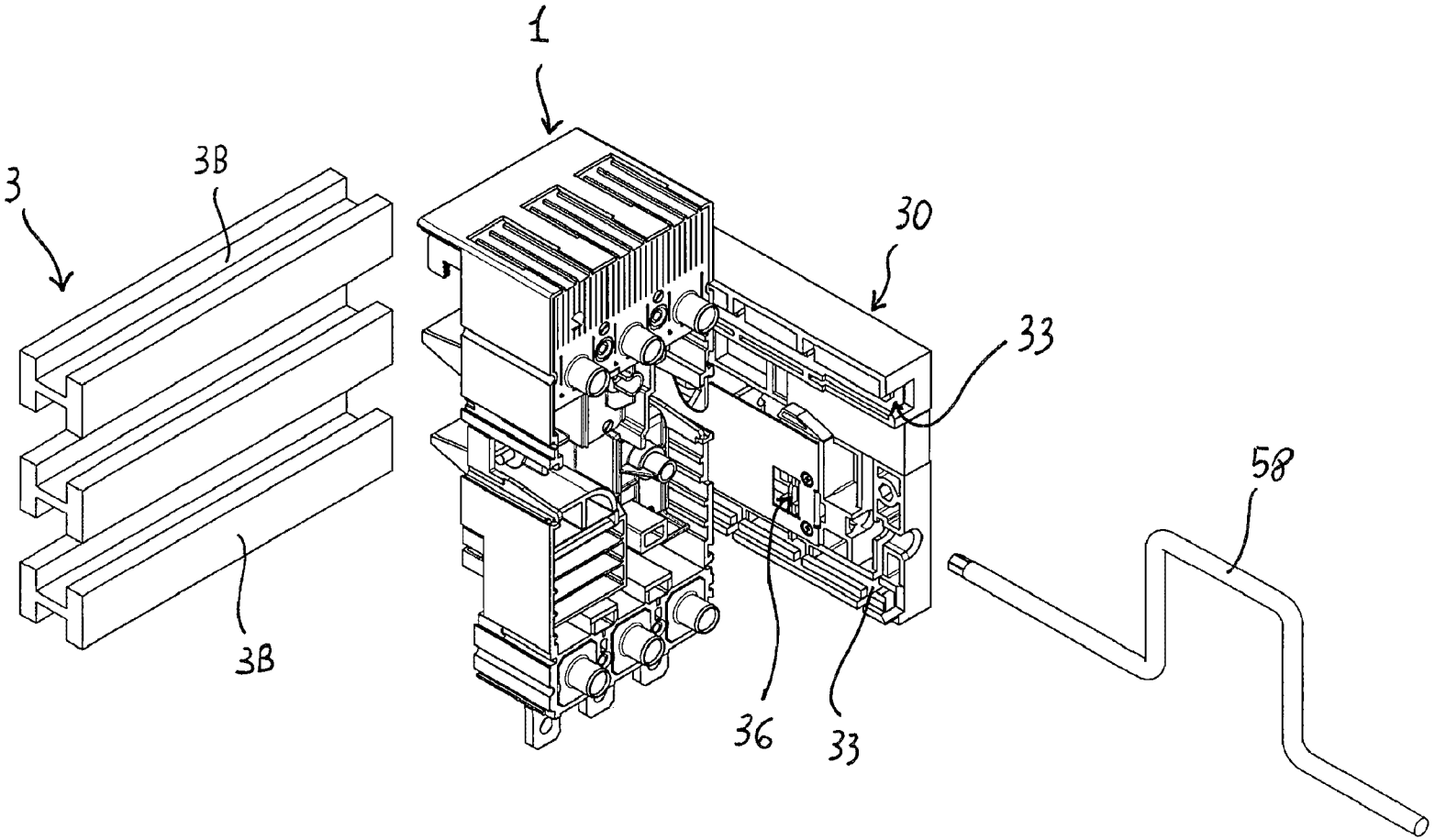
FIG. 6 is a view of an adapter device according to the invention for electromechanical connection of a plug-in switching device in a distribution bus bar system.

FIG. 6 is a view of an adapter device 1 according to the invention to which an insertion device 30 is operatively connected to allow connection of a switch of withdrawable type to this adapter device 1. The insertion device 30 comprises one or more sliding guides 33 for sliding of corresponding guide elements (not shown), provided on the flanks of the withdrawable switch 2 in order to facilitate coupling with/decoupling from the adapter 1. The insertion device 30 also comprises a drive mechanism 36 responsible for movement of the switch 2 along the sliding guides 33.

The insertion device 30 is preferably connected to one of the second lateral walls 15, 16 of the body 5 of the adapter 1 so that the sliding guides 33 are positioned according to the correct direction of insertion. The drive mechanism 36 is operated by an operator preferably through an operating crank 58 once the switch 2 has been coupled with the mechanism.

The present invention also relates to a single-pole or multipole switching device 2 comprising a case housing therein, for each pole, at least one moving contact and at least one fixed contact, which can be coupled with and decoupled from each other.}0} {0><}0 {>The switching device 2 is characterized in that it comprises a coupling wall 95, which can be coupled with a front wall 1 of the adapter device 1 according to the invention.

Figure 7:
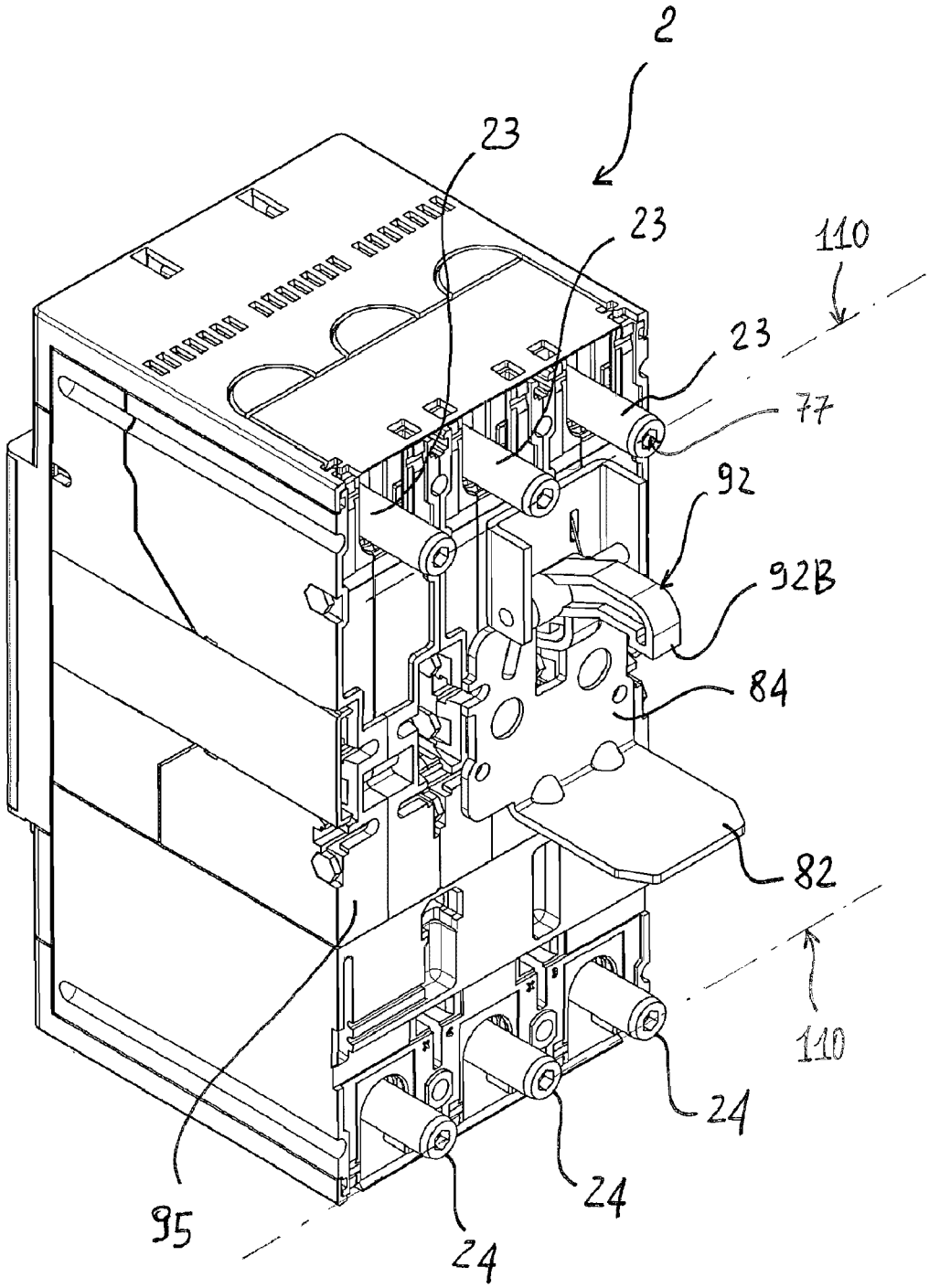
FIG. 7 is a view of a switching device connectable to an adapter device according to the invention.

FIG. 7 is a perspective view of the switch according to the invention showing in particular the back coupling wall 95 of the switch 2. This switch 2 comprises third electrical connection means 23 and fourth electrical connection means 24, each with "plug" configuration to be inserted and connected respectively with first 21 and second connections 22 with "socket" configuration, as already indicated above.

The third 23 and the fourth connections 24 are aligned according to mutually parallel directions 110 and spaced apart by the same distance between the first 21 and the second electrical connections 22 of the adapter 1. The third 23 and the fourth electrical connections 24 are preferably formed from a single piece of copper (or other equivalent conductive material) of cylindrical configuration and with a diameter so as to allow insertion in the cavity 96 defined by the body of a corresponding electrical connection 21, 22 of the adapter 1. The third 23 and the fourth electrical connections 24 with "plug" configuration also comprise a hexagonal cavity 77 to facilitate mounting of these plugs.

Again with reference to the view of FIG. 7, the switch 2 comprises second mating means which cooperate with the first mating means of the adapter 1 to allow correct coupling thereof. The second mating means comprise a guide plate 82 which emerges from the coupling wall 95 of the switch 2 orthogonal thereto. The guide plate 82 forms a first side of an L-shaped element which is connected to the coupling wall by a second side 84.

The switch 2 according to the invention also comprises second interlock means, which cooperate with the first interlock means of the adapter according to the methods defined above. With reference to the aforesaid indications on this subject, the second interlock means comprise an interlock lever 92 provided with a hook-shaped end 92B which engages, in a locked position, with a locking end 93 of the first interlock means of the adapter 1. The interlock lever 1 is operatively connected to the contacts of the switch or to other parts of the control, in any case so that its position is significant of the position of the moving contacts, or of the configuration (open, closed, tripped) of the switch 2.

Figure 8:
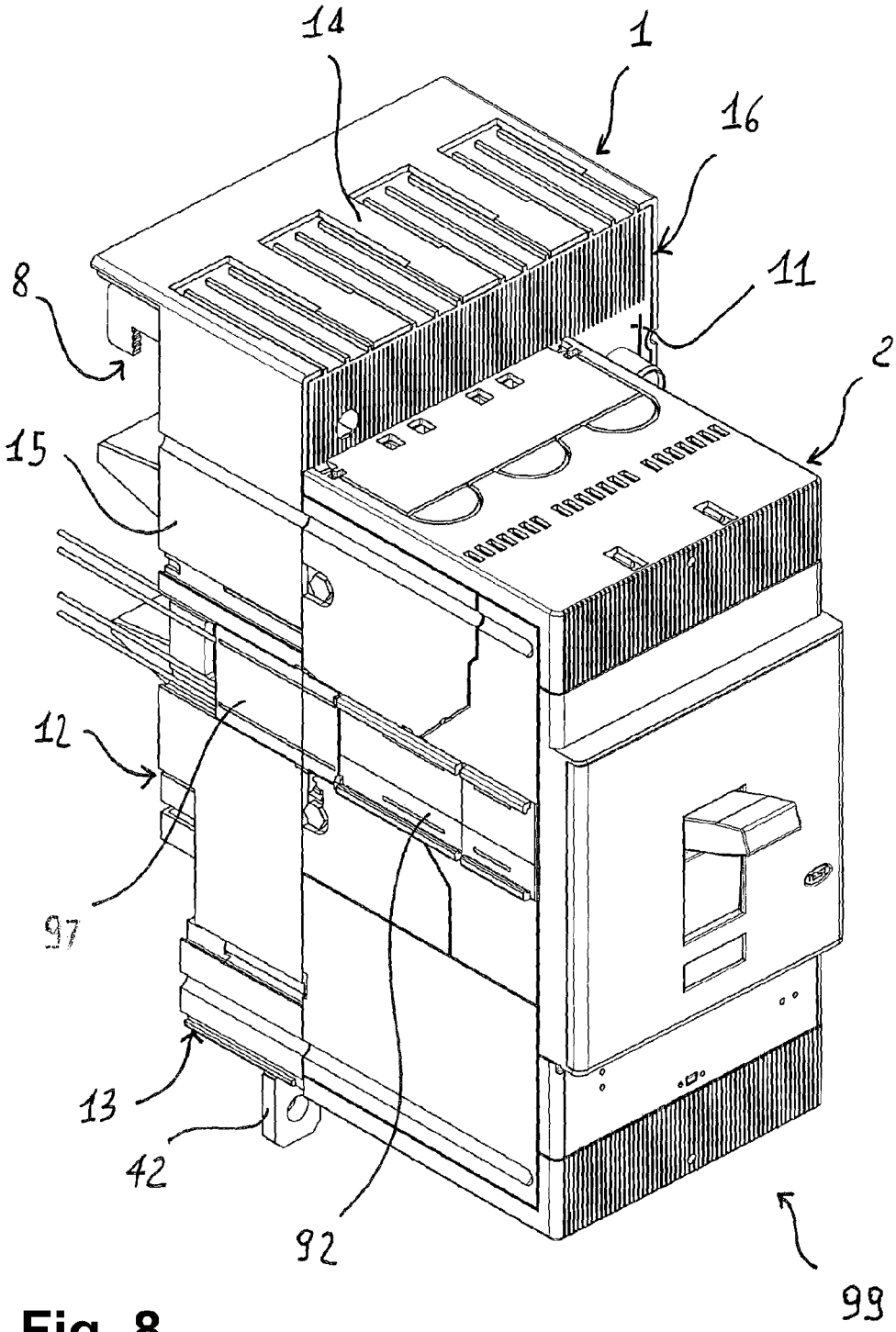
FIG. 8 is a perspective view of a switching unit comprising an adapter device according to the invention.

The present invention also relates to a switching unit 99 formed of an adapter 1 according to the invention and a switch 2 according to the invention which can be removably coupled with the adapter 1. In this regard, FIG. 8 shows a switching unit 1 formed by a three-pole switch 2 electromechanically coupled with a four-pole adapter 1 to show the functional versatility of the adapter 1 according to the invention. In other words, switching devices having a different number of poles can also advantageously be connected to the adapter 1.

FIG. 8 allows observation of coupling between first connector means 97 associated with a flank of the adapter 1 and corresponding second connector means associated with a flank of the switch 2. The connector means can, for example, comprise plugs, cables, insertion sockets, etc., or other equivalent means, according to need. The first connector means 97 of the adapter are connected downstream to the second connector means 92 of the switch 2 and can be connected upstream to a power supply system or to other electrical devices.

Figure 9:
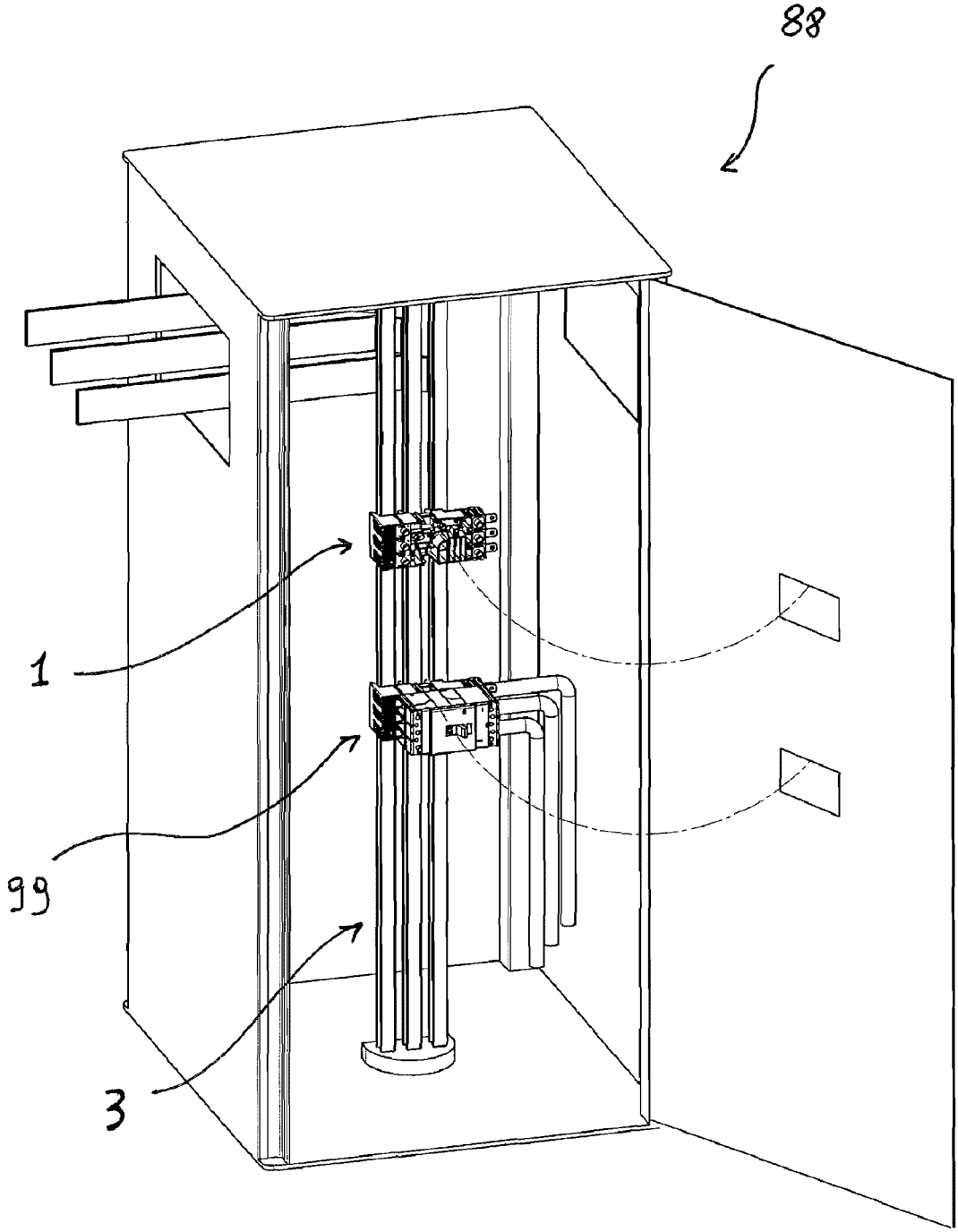
FIG. 9 is a schematic view of a switchboard comprising a plurality of adapter devices according to the present invention.

FIG. 9 is a view of a switchboard 88, inside which a bus bar system 3 with vertical configuration is placed. The technical solutions indicated above allow installation of the adapter 1 regardless of the orientation of the bus bar system 3. The adapter 2 can in fact be mounted on a horizontal bus bar system, as shown by way of example in the solution in FIG. 1, but also on a vertical bus bar system as shown clearly in FIG. 9. It is observed that besides rapid installation, the internal configuration of the switchboard 88 is particularly orderly and without rough joints to the bus bar system with evident advantages, for example of safety and reliability, and relative to inspection and maintenance operations. In particular, the reduced dimensions of the adapters and the absence of means interposed between adapters and adjacent switching units allows extremely compact installations to be obtained, also with the single utilities placed in direct contact with one another.

The technical solutions adopted for the adapter device according to the invention allow the aim and the objects set to be fully achieved. In particular, these solutions allow rapid and flexible installation of the adapter to a distribution bus bar system without requiring any prior structural work on these bus bars. At the same time, the technical solutions are such as to make the adapter extremely safe and reliable with very competitive production costs.

The adapter device thus conceived is susceptible to numerous modifications and variants, all falling within the inventive concept; moreover all details can be replaced by other technically equivalent details.

In practice, the materials used and the contingent dimensions and forms can be any, according to requirements and to the state of the art.

The invention claimed is:

1. Adapter device for connection of a low voltage switching device to a distribution bus bar system comprising:

a substantially prismatic shaped body comprising a front wall, connectable to said switching device, and a back wall opposite said front wall, said body comprising first mutually opposite lateral walls and second mutually opposite lateral walls orthogonal to said first lateral walls;

first electrical terminals emerging at least partly from said back wall and susceptible to electrically contact a distribution bus bar;

second electrical terminals emerging from one of said first or of said second lateral walls;

first electrical connections each of which is electrically connected to one of said first electrical terminals, said first electrical connections which can be coupled with corresponding third electrical connections of said switching device;

second electrical connections each of which is electrically connected to one of said second electrical terminals, said first electrical connections which can be coupled with corresponding fourth electrical connections of said switching device;

a plurality of coupling terminals, at least partly emerging from said back wall of said body, to removably connect said adapter device to said distribution bar system, each of said first electrical terminals electrically contacting one of said distribution bus bars following the action of one of said coupling terminals.

2. Adapter device as claimed in claim 1, wherein each coupling terminal emerges from said back wall at a different height (H), calculated with respect to one of said first lateral surfaces and at a different distance (D), calculated with respect to one of said second laterals surfaces, to those relative to other coupling terminals.

3. Adapter device as claimed in claim 2, wherein at least one terminal comprises a coupling portion emerging in front of said back wall at a distance so as to allow interposing of at least one portion of one of said distribution bus bars, each coupling terminal comprising reversible clamping means which drive said coupling portion in the direction of said back wall to clamp said portion of distribution bus bar between said coupling portion and said back wall.

4. Adapter device as claimed in claim 3, wherein at least one terminal comprises a pair of coupling portions emerging from said back wall in mutually parallel position, said reversible clamping means driving both said coupling portions.

5. Adapter device as claimed in claim 4, wherein said coupling portion comprises a knurled contact surface susceptible to contact a surface of said at least one part of distribution bus bar.

6. Adapter device as claimed in claim 4, wherein said body comprises one or more insulation elements interposed between the coupling portions relative to two different coupling terminals.

7. Adapter device as claimed in claim 6, wherein said insulation elements comprise at least a plurality of separators emerging from said back wall each in a position adjacent in height to the coupling portion of a relative coupling, said position in height being calculated with respect to one of said first lateral walls, said separators being produced in one piece with said body.

8. Adapter device as claimed in claim 3, wherein at least one of said first electrical terminals comprises a conductive plate which emerges from said second surface of said body in a position in front of a coupling portion of a relative coupling terminal.

9. Adapter device as claimed in claim 2, wherein said at least one of said first electrical terminals is composed at least partly of a coupling portion of one of said terminals made of conductive material.

10. Adapter device as claimed in claim 1, comprising first interlock means suitable to cooperate with second interlock means of said switching device to prevent removal of said connection when said switching device is in open configuration.

11. Adapter device as claimed in claim 1, comprising first mating means suitable to cooperate with second mating means of said switching device to guide correct coupling thereof with said adapter device.

12. Adapter device as claimed in claim 1, wherein one of said first or of said second lateral surfaces is configured to house first connector means of one or more accessory devices of said switching device, said first connector means being suitable to couple with second connector means housed on said switching device, said first and said second connector means being coupled following coupling of said switching device with said adapter device.

13. Multi-pole switching device for low voltage systems, comprising an external case containing for each pole at least one fixed contact and at least one moving contact, which can be coupled with and decoupled from each other, said external case comprising a coupling wall which can be coupled with a first surface of an adapter device according to claim 1, said switching device comprising third and fourth electrical connections suitable to electrically couple with said first and with said second electrical connections of said adapter device.

14. Switching device as claimed in claim 13, comprising second interlock means suitable to cooperate with said first interlock means of said adapter device to prevent removal of said connection when said switching device is in open configuration.

15. Switching unit for low voltage systems comprising an adapter device as claimed in claim 1 which can be removably coupled with a multi-pole switching device for low voltage systems, comprising an external case containing for each pole at least one fixed contact and at least one moving contact, which can be coupled with and decoupled from each other, said external case comprising a coupling wall which can be coupled with a first surface of an adapter device, said switching device comprising third and fourth electrical connections suitable to electrically couple with said first and with said second electrical connections of said adapter device.

* * * * *